United States Patent [19]

Turetsky

[11] Patent Number: 4,604,982

[45] Date of Patent: Aug. 12, 1986

[54] CONTROLLING AND SWITCHING MECHANISM

[76] Inventor: Isadore Turetsky, 23940 Welby Way, Canoga Park, Calif. 91307

[21] Appl. No.: 713,878

[22] Filed: Mar. 19, 1985

[51] Int. Cl.[4] ..... F02M 51/00

[52] U.S. Cl. ..... 123/477; 123/146.5 A

[58] Field of Search ..... 123/146.5 A, 477

[56] References Cited

U.S. PATENT DOCUMENTS 3,587,535 6/1971 Kimberley et al. ..... 123/146.5 A X 3,605,712 9/1971 Ford ..... 123/146.5 A 4,488,530 12/1984 Turetsky ..... 123/477

*Primary Examiner*—Tony M. Argenbright

[57] ABSTRACT

A controlling and switching mechanism utilizing radiant energy to activate each radiant energy sensitive switching member for applying an energizing pulse to its associated fuel injector of an internal combustion engine; the mechanism using a beam of radiation for each switching member, and having means for optionally varying the relative position of each beam striking its associated member in timed relationship with the operating engine shaft. The duration of an energizing pulse, in degrees of engine shaft rotation, is a function of that part of the switching member illuminated by the beam of radiant energy; the switching members being of sufficient magnitude along at least one dimension so that different parts of each switching member can be exposed to its associated recurring beam of radiant energy.

6 Claims, 6 Drawing Figures

CONTROLLING AND SWITCHING MECHANISM

FIELD OF THE INVENTION

This invention relates to electromechanical controlling and switching mechanisms activated by radiant energy, preferably light, for use in a fuel injection system of an internal combustion engine.

Several devices utilizing radiant energy, and photo responsive members have been designed for use in the fuel injection systems of internal combustion engines.

Some systems utilize a disk rotating in timed relationship with the engine, and having one or more apertures therein; said disk rotating between a light source and one or more photo responsive cells. The intermittent light signals are transmitted to the cells in proper sequence for generating an output pulse to actuate the fuel injectors. The duration said fuel injectors remain actuated to deliver fuel is determined by a time delay circuit which is regulated by a relatively complex electronic control unit.

One system uses a trigger contact mechanism to generate pulses in proper sequence, and a relatively complex electronic control unit to regulate the time delay circuit for proper fuel injection.

Still another system uses an opaque element having a tapering slot, said element being disposed between the source of radiation and the members responsive to said radiation. The duration of the output pulse is governed by the position of the slot relative to said members, and is varied by axially shifting the radiation sensitive members or the opaque element which rotates in timed relationship with the engine. Such an arrangement is mechanically difficult to maintain for precise timing.

OBJECT OF THE INVENTION

It is an object of my invention to provide a switching mechanism having relatively simple means with which to control the duration of an energizing pulse to each fuel injector of an internal combustion engine.

Another object of the invention is to offer a simple means for timing the energizing pulse to each fuel injector.

Embodiments of my invention capable of accomplishing the foregoing objects and providing the advantages contemplated by them and other advantages will become more apparent after studying the detailed description of the following specification which may be readily understood by reference to the accompanying drawings.

DETAILED DESCRIPTION OF THE DRAWINGS

Figure 1:
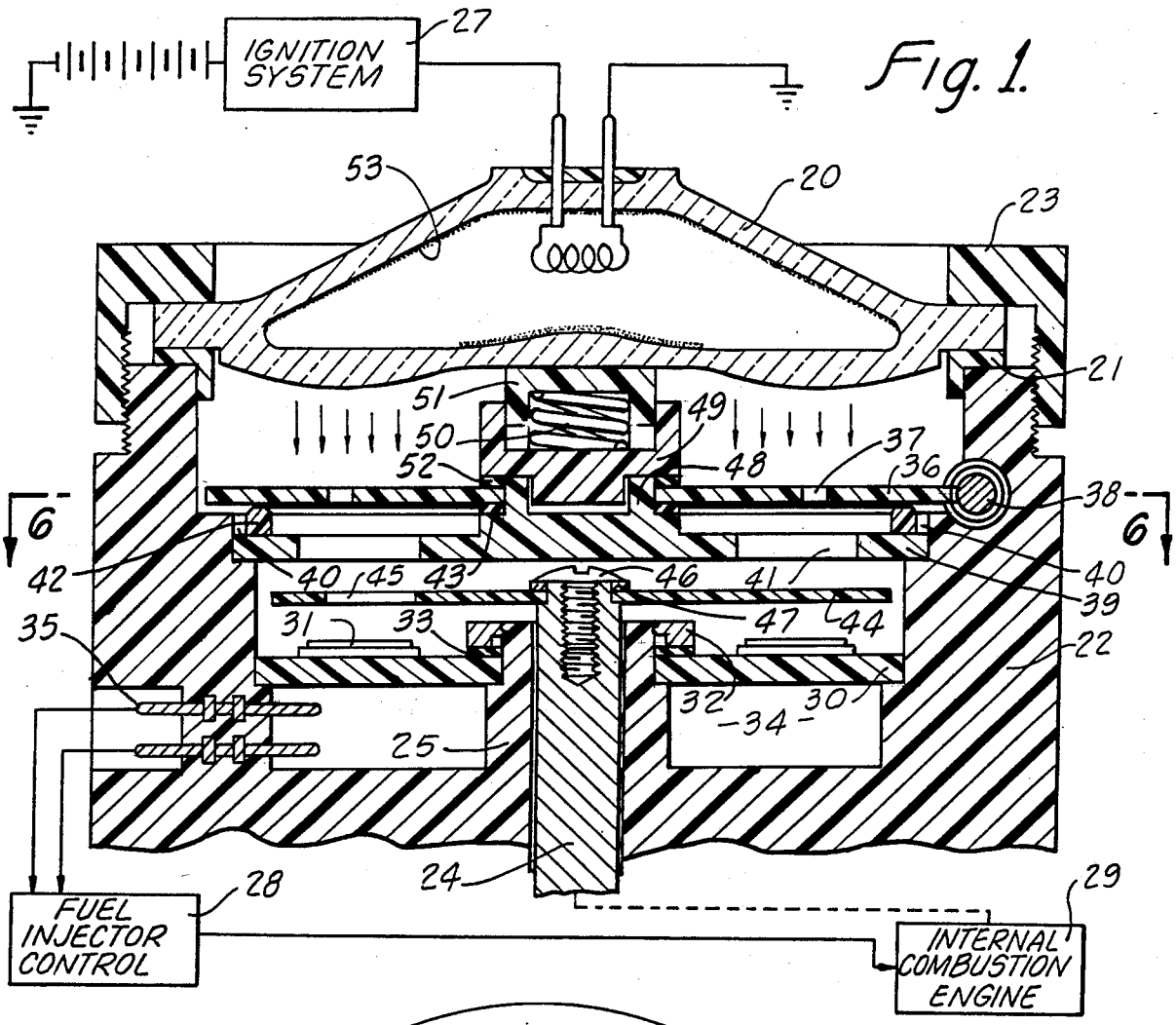
FIG. 1 is a sectional view of the switching mechanism housing illustrating the relative positions of elements enclosed within said housing.

Referring to FIG. 1 which is for illustrative purposes only, the sealed beam lamp 20 is disposed on gasket 21, said gasket resting on the upper end wall of switching mechanism housing 22. The lamp 20 is held in position by means of threaded ring nut 23 which is screwed onto the threaded upper end section of housing 22. The shaft 24 passes through the bore of internally extended hub 25 of housing 22, so that one end of said shaft extends above the end of said hub 25. The shaft 24 can be coupled by gears or other suitable means, so that said shaft operates in timed relationship with the engine crankshaft. The lower disk 30 has a plurality of light activated switching members 31, and is placed in position by means of a flat surface (not shown) on its otherwise concentric bore; said flat surface being disposed adjacent to a flat surface on the outside wall of hub 25. The lower disk 30 is held in position by means of threaded nut 32 which is screwed onto the upper threaded end section of hub 25, and bears against washer 33 which is disposed between said nut 32 and disk 30. Concentric raceway 34 facilitates placing and connecting each of the wires (not shown) to their respective switching members, and associated connector pins 35 which are adapted for insertion into a plug (not shown), thereby electrically connecting the switching members to fuel injector control 28 of the internal combustion engine 29, so that each light sensitive switching member is connected in electrical circuit to its associated fuel injector.

The uppermost disk 36 has an aperture 37 for each switching member 31 fixed on disk 30. A sector of disk 36 has a series of teeth at its outer circumference which mesh with teeth of circular rack gear 38. By use of the circular rack gear 38 the disk 36 can be rotated to a desired operating position, and held stationary in that position.

One means for supporting disk 36 is by use of disk 39 which rests on a shoulder in housing 22, and maintained in position by means of slots 40 in wall of said housing. The supporting disk 39 has a plurality of apertures 41. It is preferable but not necessary for apertures 41 to be equal in number and have similar projected dimensions as the switching members in lower disk 30. The rotatable disk 36 rides on a ring insert 42 and washer 43 which are disposed between said disk 36 and disk 39. Rotatable disk 36 is held in position by means of raised hollow hub 48. The floating spring guide 49 inserted in hollow hub 48 and acted upon by spring 50 which is compressed by means of sliding cap 51 and the wall of lamp 20 prevents excess vertical movement of disk 36. Washer 52 is disposed between spring guide 49 and disk 36. Disk (or chopper) 44 has an aperture 45 and is positioned at the upper end section of shaft 24 by means of a flat surface (not shown) on said shaft upper end section, and a flat surface on the otherwise concentric bore of chopper 44; said chopper being held in position by means of screw 46, and washer 47 which is disposed between the head of said screw and said chopper. The sealed beam lamp 20 which is preferably electrically connected to the ignition system 27 has selected reflective surfaces 53 so that a ring of light (as shown by arrows) will be directed toward upper disk 36 when the ignition system is energized.

Figure 2:
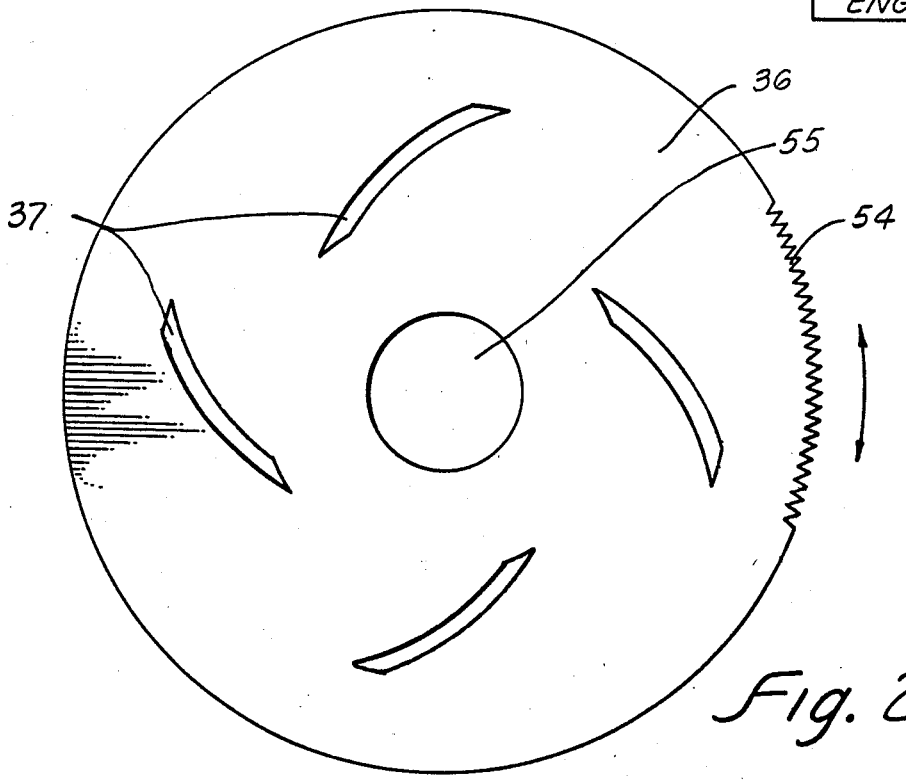
FIG. 2 is a plan view of the uppermost disk of the switching mechanism shown in FIG. 1.

FIG. 2 shows a plan view of upper disk 36 having teeth 54 at the outer circumference of a sector of said disk. Also shown are apertures 37 and a concentric bore 55; the number of apertures 37 being equal to the number of light activated switching members fixed on lower disk 30.

Figure 3:
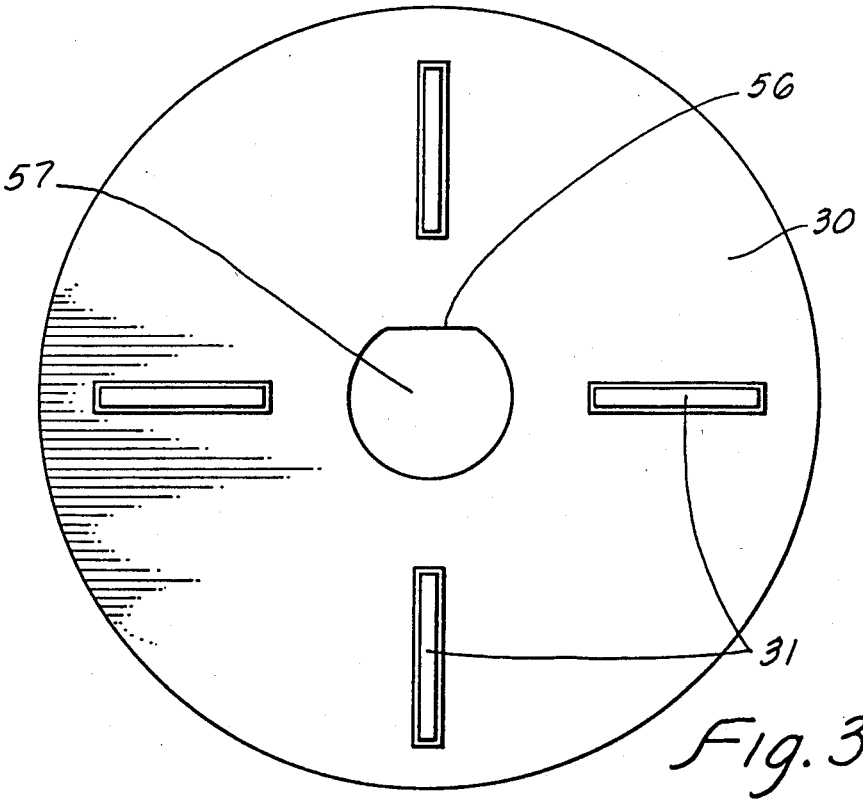
FIG. 3 is a plan view of the lowermost disk and its radiation activated members.

FIG. 3 is a plan view of the lower disk 30 having a plurality of light activated switching members 31 with the electrical connections not shown. The disk 30 can preferably be made of plastic or other non-metallic material, and have printed circuits to facilitate manufacturing precision and economy. The flat surface 56 on the otherwise concentric bore 57 of disk 30 is used to locate and hold said disk 30 in position within the housing; said flat surface 56 disposed adjacent the flat section of the outside wall of internally extended hub 25.

Figure 4:
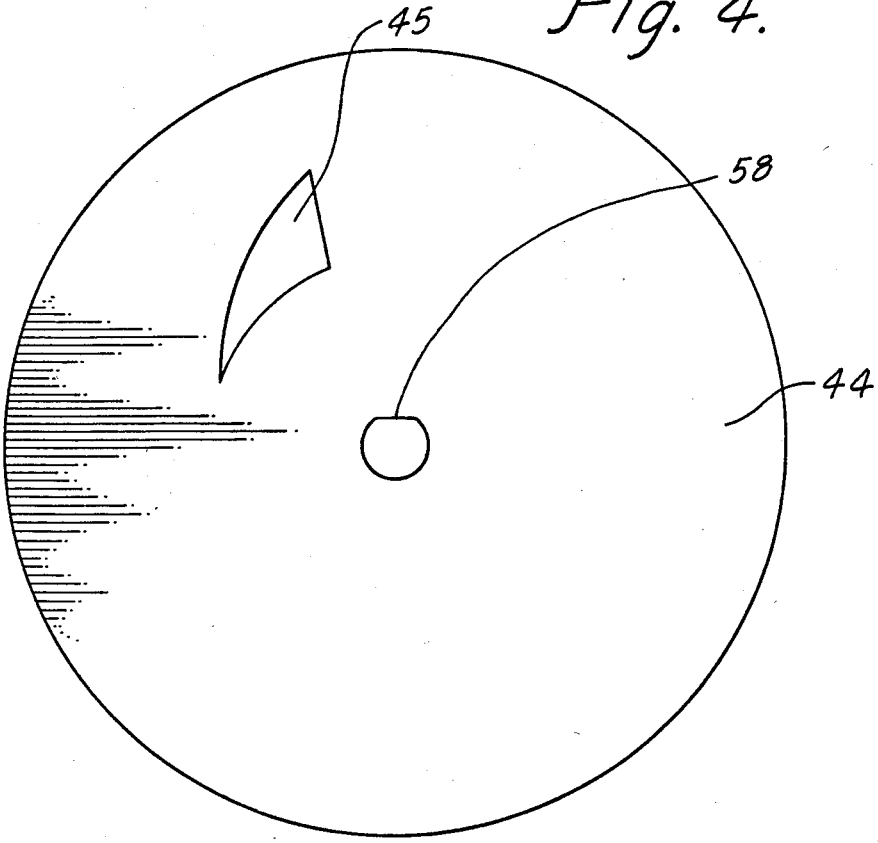
FIG. 4 is a plan view of the disk immediately above the lowermost disk shown in FIG. 3.

FIG. 4 is a plan view of chopper (disk) 44 which rotates in timed relationship with the engine crankshaft. Shown across the otherwise concentric bore is the flat surface 58 which is used to position disk 44 on shaft 24. Also shown is aperture 45. The length of a circular section of aperture 45 varies inversely as its distance from the center of disk 44.

Figure 5:
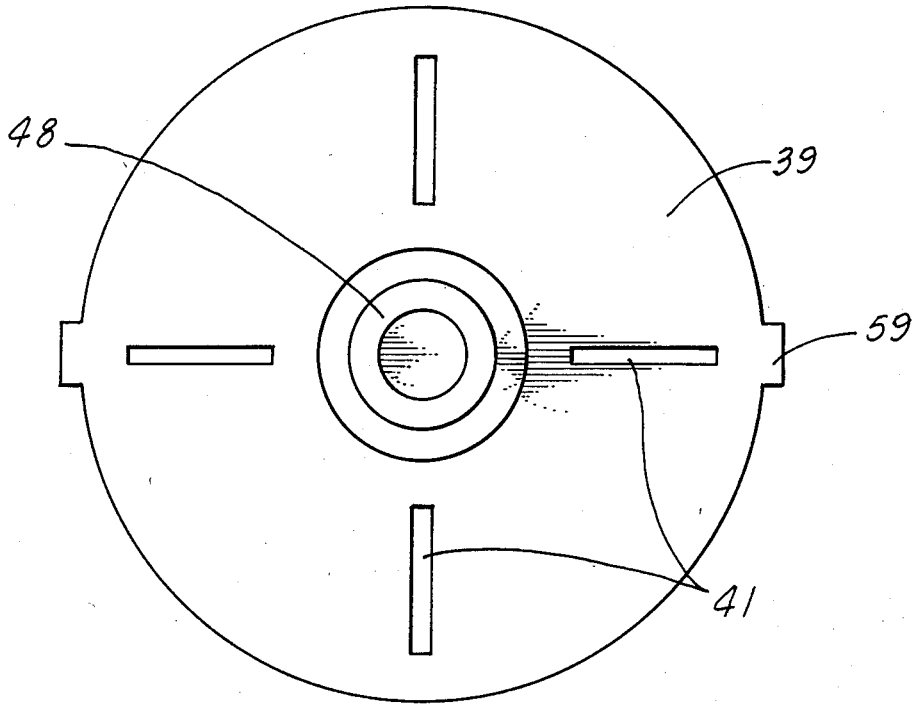
FIG. 5 is a plan view of the disk disposed immediately below the uppermost disk shown in FIG. 2.

FIG. 5 is a plan view of disk 39 which is positioned intermediate uppermost disk 36 and chopper 44. Shown are apertures 41 which are positioned in line with the projected area of their associated switching members on disk 30. Also shown are ears 59 which are inserted into their respective slots 40 in housing 22, thereby preventing rotation of disk 39. Also shown is the integral extended hollow hub 48. The apertures 41 can preferably but not necessarily be of similar geometric dimension as the switching members, so as to help prevent extraneous light rays from striking a switching member.

Figure 6:
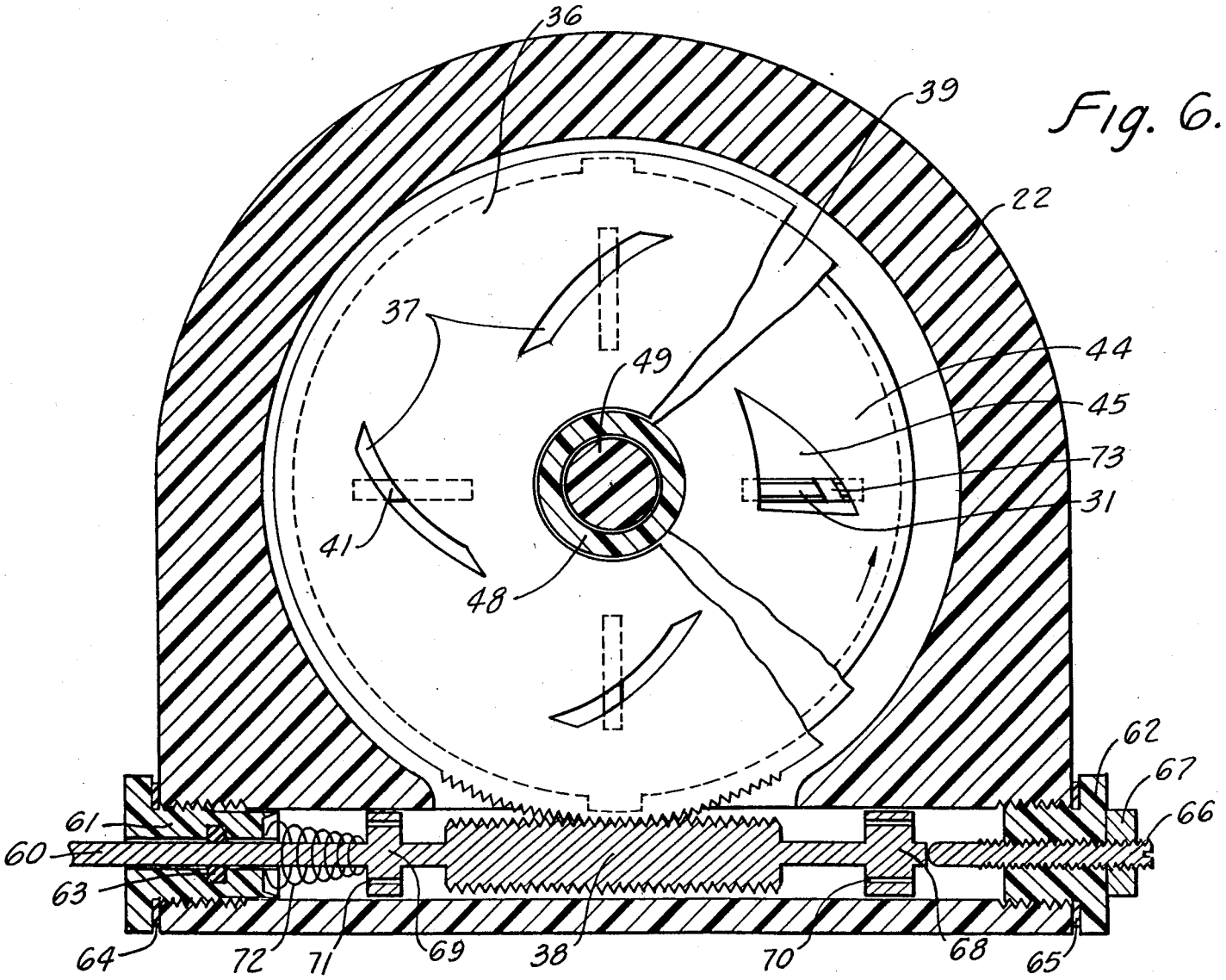
FIG. 6 is a transverse sectional view taken along line 6—6 of FIG. 1, and having breakaway sections for clarity and explanatory purposes.

FIG. 6 is a transverse sectional veiw taken along line 6—6 of FIG. 1 and having breakaway sections for explanatory purposes. Shown is uppermost disk 36 with its apertures 37. Also shown is a section of disk 39 with its extended hollow hub 48 and a section of spring guide 49. The circular rack gear 38 enclosed within housing 22 by means of straight threaded gland nut 61 and idling screw retaining nut 62; said gland nut 61 retaining an "O" ring 63 which is positioned around the extended control shaft 60 of rack gear 38 to facilitate keeping a clean interior of housing 22. Disposed between the shoulder of gland nut 61 and housing 22 is gasket 64. Located between the shoulder of idling screw retaining nut 62 and housing 22 is gasket 65. The threaded idling adjusting screw 66 is held in position within retaining nut 62 by means of locknut 67. The rack gear 38 is supported by its two integral collars 68 and 69 having passages 70 and 71 respectively. The collar 68 rests against idling adjusting screw 66 during idling engine operation. Spring 72 disposed between collar 69 and gland nut 61 is under compression so as to return the rack gear 38 to idle position when the controlling force applied to the extended shaft of said rack gear is released. Passages 70 and 71 in collars 68 and 69 respectively prevent entrapment of air between said collars and their associated gland nuts for proper operation of the rack gear 38. Shown through each aperture 37 is a section of associated aperture 41 of disk 39 through which a beam of light is directed toward the chopper 44 having aperture 45. The light beam will strike a switching member 31 on lower disk 30 when the aperture 45 in rotating chopper 44 exposes that part of the switching member in line with its associated beam of light 73. It will be noted that moving the rack gear to rotate uppermost disk 36 clockwise will shift the effective beam of light toward the center of said disk 36, thereby permitting a greater circular section of aperture 45 in chopper 44 to expose each switching member to its associated light beam for a longer duration, in degrees of engine shaft rotation, with a resulting increased energizing pulse duration. The disk 44 with its aperture 45 is shown rotating in a counterclockwise direction with the engine idling. The cylindrical ring of light (not shown) is projected in the direction of the disks, the apertures of the disks and the switching members functioning within said projected ring of light. The apertures 41 of disk 39 can be enlarged to permit the entire beam of light emanating from apertures 37 to strike the lower disk 30 via aperture 45 of chopper 44. This will not have an adverse effect on engine operation, as only that part of the shifted recurring beam striking that part of the switching member will determine energizing pulse duration. Although it is preferable to optionally rotate disk 36 the mechanism can be designed so that said disk 36 is stationary with lower disk 30 being optionally rotated to vary engine load. It will be obvious to one skilled in the art that though it is preferable to have the radiant energy sensitive switching members 31, the apertures 37 and 41 radially oriented as shown the mechanism can be designed so that said members and apertures are circular arc shaped, and disposed around a common diameter, with a similarly disposed circular arc shaped aperture 45. The timing of fuel injection can be adjusted by the same method used for a common distributor; that is to rotate the housing 22 (with disks 30, 39, and 36) to a desired position, and then similarly fixing the housing.

While those embodiments of this invention hereinbefore illustrated and described are fully capable of performing the objects and accomplishing the advantages primarily stated, it is understood that this invention is not restricted to the specific embodiments hereinbefore set forth, but includes all modifications coming within the scope of the claims that follow.

I claim:

1. In a fuel injection system for an internal combustion engine, a controlling and switching mechanism using radiant energy for controlling the sequential operation of the fuel injectors, said mechanism comprising:

A source of radiant energy

A first element having a plurality of switching members which are activated by said radiant energy and fixed to said element, said members electrically connected in the circuit controlling their associated fuel injectors A second element disposed between the source of radiant energy and said switching members, said second element having a plurality of apertures therein through which beams of radiant energy are directed, there being an aperture for each switching member; said second element adapted for optional rotation so that each beam of radiant energy emanating from each aperture and directed toward said first element can be shifted with respect to its associated switching member A third element disposed intermediate said first and second element, said third element having an aperture therein and rotating in timed relationship with the engine shaft, so that each switching member is activated by its associated beam by means of the rotating aperture in said third element; the duration of an energizing pulse when said switching member is activated, in degrees of engine shaft rotation, being a function of that part of the switching member illuminated by its associated beam of radiant energy.

2. The invention defined in claim 1 in which the radiant energy is light.

3. In a fuel injection system for an internal combustion engine, a controlling and switching mechanism using radiant energy to control the operation of each fuel injector, said mechanism comprising:

A source of radiant energy

A first element having at least one switching member which is sensitive to said radiant energy, said member electrically connected in the circuit controlling its associated fuel injector, and having sufficient magnitude along at least one dimension so that varying parts of said switching member along said dimension can be optionally illuminated by a beam of said radiant energy A second element disposed intermediate said first element and said source of radiant energy and having an aperture therein through which a beam of radiant energy is directed, there being an aperture for each switching member; one of the aforementioned two elements adapted for optional movement, so as to alter the position of said beam of radiant energy with respect to its associated switching member A third element disposed intermediate said first and second elements and having an aperture therein; said third element rotating in timed relationship with the engine shaft, thereby exposing each radiant energy sensitive switching member to its associated beam of radiant energy by means of the aperture in said third element; the length of an energizing pulse when a switching member is activated, in degrees of engine shaft rotation, is a function of that part of the switching member illuminated by it associated beam of radiant energy.

4. In a fuel injection system for an internal combustion engine, a controlling and switching mechanism using radiant energy for controlling the operation of the fuel injectors, said mechanism comprising:

A source of radiant energy

A first element having at least one switching member which is activated by said radiant energy, and electrically connected in the circuit controlling its associated fuel injector; means for directing a beam of said radiant energy toward said switching member and optionally shifting said beam with respect to said member; a chopper disposed intermediate said switching member and said beam of radiant energy, the chopper operating in timed relationship with the engine shaft; the length of an energizing pulse when said switching member is activated by said beam of radiant energy, in degrees of engine shaft rotation, being a function of that part of said switching member illuminated by said beam the switching member having sufficient magnitude along at least one dimension so that said beam can strike and illuminate varying parts of said member along that dimension.

5. The invention defined in claim 4 in which said means is a second element having an aperture for each switching member disposed intermediate the source of radiant energy and said chopper, each beam of radiant energy emanating through its associated aperture being directed toward said first element; said second element adapted for optional rotation so as to shift the beam of radiant energy with respect to its associated switching member.

6. The invention defined in claim 4 in which said first element is adapted for optional movement so as to alter the position of each switching member with respect to its associated beam of radiant energy.

* * * * *